United States Patent [19]

Satchell

[11] 4,227,541

[45] Oct. 14, 1980

[54] HAIR CURLING APPARATUS

[75] Inventor: David C. Satchell, Eastbourne, England

[73] Assignee: David Satchell Products Limited, Kent, England

[21] Appl. No.: 936,068

[22] Filed: Aug. 23, 1978

[51] Int. Cl.[3] ..... A45D 2/24

[52] U.S. Cl. ..... 132/37 R

[58] Field of Search ..... 132/37 R, 9; 219/229

[56] References Cited

U.S. PATENT DOCUMENTS

| | | | |
|---|---|---|---|
| 1,630,078 | 5/1927 | Smith | 132/37 R |
| 1,657,306 | 1/1928 | Gursky | 132/37 R |
| 2,491,845 | 12/1949 | Beer | 132/37 R |
| 3,102,941 | 9/1963 | Pope | 132/37 R |
| 3,534,392 | 10/1970 | Trouilhet | 132/37 R |

*Primary Examiner*—G. E. McNeill

*Attorney, Agent, or Firm*—Schwartz, Jeffrey, Schwaab, Mack, Blumenthal & Koch

[57] ABSTRACT

Portable hair curling apparatus particularly characterized by a resistance element having a plurality of individual wire strands, storage cells, and a three position switch for heating the strands or adapting the device for recharging of the cells. The switch and cells are positioned within the handle, the rear end of which is partially open and has mounted therein contacts to permit recharging of the cells.

6 Claims, 1 Drawing Figure

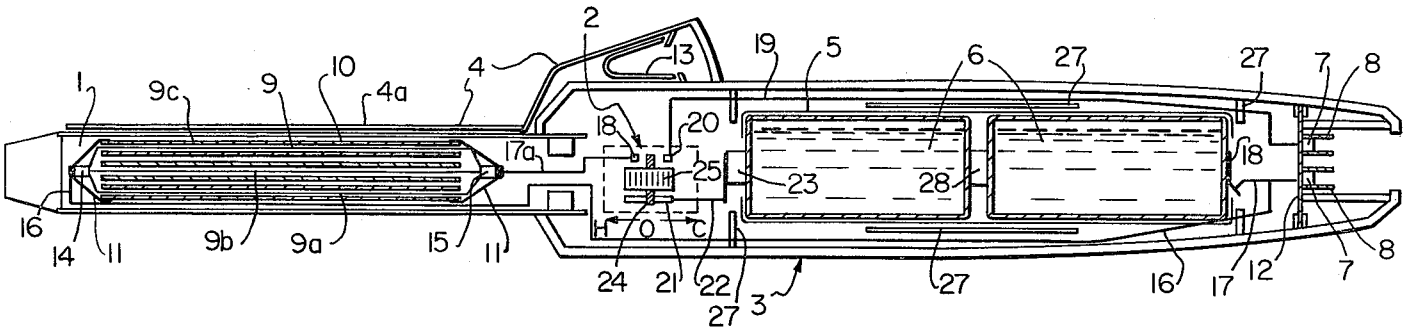
8
7
27
18
8
7
12
17
16
27
6
28
27
5
23
19
3
22
27
20
25
21
13
24
2
18
17a
4
11
15
4a
10
9a
9
9b
9c
11
1
14
16

HAIR CURLING APPARATUS

BACKGROUND OF THE INVENTION

The present invention relates as indicated to hair-curling apparatus.

A form of hair-curling apparatus in widespread use is the type generally known as hair-curling tongs. During the initial stages of development of these tongs, they were heated by a fixed flame or by means of mains electricity. This obviously restricted the portability of the apparatus and essentially confined the same to home use.

My British Pat. No. 1,326,121 discloses an electrically heated curling apparatus constructed for portability through the use of an energy source comprising electrical storage cells. The metal tong portion was removably mounted in one end of the handle of the apparatus when in the operative position, and engaged contacts in the adjacent end of the handle. Current from the electrical storage cells was thereby established for heating the tong portion. Following use of the tong, the same could be removed from the handle, reversed upon itself, and reinserted through the handle to a storage position.

Although my prior patent curling apparatus has proved generally satisfactory, it does possess certain disadvantages. The heating element in my earlier form comprised a resistance element in coil form electrically connected at one end to the tong portion and at its other end to a contact pin in electrical contact with the storage cells through the body of the tong portion. This arrangement presented certain manufacturing difficulties and also produced relatively inefficient heating due to the presence of air pockets within the tong which act as thermal insulators. Moreover, the breaking or cracking of one cross-sectional area of the resistance element rendered the device inoperable. Still further, there was no provision for recharging the storage cells thereby placing a fixed life span on the apparatus dependent on the life span of the storage cells, or requiring periodic replacement of the cells.

SUMMARY OF THE INVENTION

The principal object of the present invention is to provide an improved hair curling apparatus having distinct advantages over my earlier apparatus described above, and other hair curling apparatus of this general type of which I am aware. In accordance with the invention, the heating element comprises a plurality of strands thereby permitting the element and insulating sleeves around each strand to occupy most of the interior area of the tong portion, thus reducing the air pockets thereby to improve the heat transfer to the body of the tong section. In addition, by providing a resistance element comprised of a plurality of strands, one or two strands can break or fail, and although the loss of heat output will consequently result, the device remains operable. Moreover, the individual strands comprising the resistant element comprise straight insulated strands of wire, which facilitates manufacture.

The improved hair-curling apparatus in accordance with the invention is further characterized by the inclusion of a three position on-off switch housed within the handle of the apparatus, with the switch having an exposed slide button by means of which the device can be placed in either an on or heating condition, and off condition, or a charging condition which adapts the device to reception of a recharger unit. To facilitate such recharging, the end of the device opposite the tong section is constructed for reception and contact engagement with a recharging unit for recharging the apparatus between uses thereof. A rugged plastic handle encapsulates the switch, as above noted, as well as the storage cells and the end of the apparatus adapted to be coupled with the recharging unit.

These and other objects will be apparent as the following description proceeds in particular reference to the application drawing.

BRIEF DESCRIPTION OF THE APPLICATION DRAWING

The single FIGURE comprising the application drawing is a longitudinal cross-sectional view through the hair curling apparatus of the present invention.

DETAILED DESCRIPTION OF THE PREFERRED EMBODIMENT

Referring in more detail to the drawing, the apparatus comprises a metal tong portion 1, a three-position on/off/charge switch generally and schematically indicated at 2, and a handle 3 which encloses the switch and also the storage cells 5 and 6. Brass contact pads 7 and protective insulating shrouds 8 disposed around the pads 7 are mounted on an insulated contact board 12 mounted adjacent the open end of the handle.

A curling clip 4 is provided in the usual manner with the leading end **4*a* thereof having a curvature corresponding to the curvature of the tong portion 1. The upper part of the clip 4 is spaced from the handle 3 and is biased to the position shown in the application drawing by a leaf spring 13. As will be evident, the spring 13 returns the spring clip to its illustrated position, from which the clip can be depressed for raising the front portion of the clip disposed adjacent the metal tong. An opening is provided in the handle 3 for receiving the end of the upper part of the clip 4 when the clip is depressed. This construction is well known, and it will be understood that the clip is hinged to the apparatus adjacent the rear end of the curved portion 4*a*** of the clip to permit the raising of the clip away from the tong during use of the device.

The handle 3 is preferably formed of a rigid plastic material, for example, polycarbonate, and the cells 6 are encapsulated in a plastic insulating cover 5 which can be shrunk around the cells and which can be formed, for example, from polyvinylchloride.

The heating element 9 includes a plurality of individual strands shown in the drawing at **9*a*, 9*b* and 9*c*, which are spaced and encased in insulated sleeve members commonly designated at 10. The sleeves are preferably made of glass fiber, as are the end covers 11 which enclose the heating assembly. The ends of the strands 9*a*–9*c* are in electrical contact with front and rear connector members 14 and 15, respectively, with a lead wire 16 passing to line 17 electrically connected to terminal 18 of the rearmost rechargeable cell 6. A second lead wire 17*a* extends from the rear connector 15 to switch contact 18, with lead line 19 being connected to and extending from the other switch contact 20 to the uppermost brass contact pad 7. Although three strands 9*a*–9*c* are shown in the drawing, it will be understood that more than three are preferred, each insulated from one another as shown, in order to substantially completely occupy the space within the tong portion. The insulated strands are retained within the end covers 11**.

Switch 2, partially diagrammatically illustrated, further includes a bottom conductive member 21 to one end of which is secured a lead wire 22 secured to the front terminal 23 of the rechargeable cell 6 shown leftmost in the application drawing.

The settings of the switch 2 are shown as "H" (for Heat), "C" (for Charge) and "O" (for Off). A conductor member 24 is secured to the bottom switch member 21 and is carried by a switch button 25 which can be exposed outwardly of the handle 3 of the conductor member. If desired, the conductor member 24 can be apertured for sliding movement relative to the conductive member 21.

The member 24 can thus be moved into contact with switch contact point 18 for establishing a circuit between the cells 6 and the strands 9*a*–9*c* of the tong 1, with the circuit including terminal 23, line 22, member 21, conductor 24, contact point 18, line 17, and connector 15 to which the strands are electrically connected. The wire 16 connected to the front connector 14 is in electrical engagement with the rear terminal 18 through line 17 to complete the circuit.

When the device is not in use and it is desired to recharge the cells 6, the switch button 25 is moved to a position wherein the conductor engages the switch contact 20 thereby establishing contact with the brass contact pads 7 of the recharging end of the device. The circuit is completed through line 22, terminal 23, the cells 6, line 17 which is in electrical contact with the brass pad 7, and line 19. The circuit to the resistance element 9 is thus open during recharging of the cells.

The tong portion 1 can be secured to the handle 3 in any suitable manner, and the entire device can be assembled and sold with a recharging unit as a complete kit.

The handle 3 is preferably integrally formed with radially and axially extending spacing tabs commonly indicated at 27 for retaining the encapsulated storage cells 6 in a relatively fixed position within the handle.

The cells 6 are electrically interconnected by terminals in a well known maner, terminal 28 being shown in the drawing.

The operation of the device should be apparent from the above description. Through switch 2, the strands of the heating element 9 can be energized and the clip portion 4 pivoted away from the tong. The clip is then released and is biased toward its illustrated position by spring 13 to retain the clipped hair for curling purposes. After using, the device can be recharged by movement of the control button 25 to "C" position, adapting the unit for contact engagement with a recharging unit for recharging the cells 6.

It will thus be seen that the portable curling apparatus is extremely simple, while at the same time providing significant advantages when compared with the prior art above described. The provision of a resistance element in the form of a plurality of strands connected in parallel provide highly efficient heat transfer to the surface of the tong, with the strands and insulating sleeves reducing the air pockets within the tong. The apparatus can be switched to three different positions, and is constructed to permit the storage cells to be recharged thereby extending the life of the cells.

I claim:

1. Hair curling apparatus comprising (a) a handle, (b) a tong portion secured to and extending from the front of said handle, (c) a spring loaded clip mounted outwardly of said handle and said tong portion and biased toward the latter, (d) an energy source in the form of electrical storage cells mounted within said handle, (e) resistance element means mounted within said tong portion and comprising a plurality of individual strands the ends of which are commonly connected to electrical connector elements, each strand being encased in an insulating sleeve, with the strands and sleeves occupying substantially the entire area within the interior of said tong portion thereby reducing insulating air pockets within said tong portion, (f) contact means for recharging said storage cells mounted in the rear end of said handle, the latter being open at such end for mating connection with a recharging source, (g) a three-way switch mounted within said handle and including a switch actuator exposed exteriorly of said apparatus for operating said switch, said switch having terminal settings for alternately heating said resistance element means or recharging said storage cells, and a third position between said terminals for an off or deactuated condition, and (h) circuit means electrically interconnecting said switch with said resistance element means, said storage cells, and said contact means for recharging said storage cells.

2. The apparatus of claim 1 wherein end covers are provided having a generally circular radially outer end which extend over the insulating sleeves to form an assembled unit, with said end covers having mounted therein said electrical connector elements which are in electrical contact with said strands, and lead wires electrically connected to said connector elements and to said switch and said storage cells.

3. The apparatus of claim 2 wherein said end covers and said insulating sleeves are formed of glass fibers.

4. The apparatus of claim 1 wherein said handle is formed of plastic material and includes spacer means integrally formed therewith on the interior surface thereof for confining the movement of said storage cells.

5. The apparatus of claim 4 wherein said storage cells are encapsulated in a sleeve of plastic material.

6. The apparatus of claim 1 wherein said contact means for recharging said storage cells comprise brass contact pads encased in protective insulating shrouds, with the pads and shrouds being mounted on a contact board secured at the perphery thereof to said handle.

* * * * *